United States Patent [19]

Mills et al.

[11] Patent Number: 4,700,634

[45] Date of Patent: Oct. 20, 1987

[54] LAP-ORIENTED PORTABLE DESK UNITS

[76] Inventors: Arthur Mills, 35 Cedar Hill, Weston, Conn. 06883; Kenneth B. Curtis, 108-25 Seventy Second Ave., Forest Hills, N.Y. 11375

[21] Appl. No.: 864,033

[22] Filed: May 16, 1986

[51] Int. Cl.[4] ..... A47B 23/00

[52] U.S. Cl. ..... 108/43; 248/444; 190/11; 362/98

[58] Field of Search ..... 312/223, 244, , 233; 190/10, 11; 362/133, 155, 156, 154, 98, 253; 108/43; 248/444

[56] References Cited

U.S. PATENT DOCUMENTS

| | | | |
|---|---|---|---|
| 52 | 1/1860 | Garnett | 312/244 |
| 1,364,022 | 12/1920 | Bauer | 108/43 |
| 1,613,440 | 1/1927 | Carek | 108/43 |
| 1,985,335 | 12/1934 | Bloss | 362/155 |
| 2,471,003 | 5/1949 | Monohan | 108/43 |
| 2,670,260 | 2/1954 | Watt | 108/43 |
| 3,104,131 | 9/1963 | Krone | 312/244 |
| 3,215,453 | 11/1965 | Malcom | 108/43 |
| 3,232,685 | 2/1966 | Wilstein et al. | 312/223 |
| 3,631,235 | 12/1971 | Odermann | 362/133 |

FOREIGN PATENT DOCUMENTS

| | | | |
|---|---|---|---|
| 0167801 | 3/1951 | Fed. Rep. of Germany | 362/98 |
| 0783450 | 4/1935 | France | 362/98 |

*Primary Examiner*—Kenneth J. Dorner
*Assistant Examiner*—Gerald A. Anderson
*Attorney, Agent, or Firm*—Mattern, Ware, Stoltz & Fressola

[57] ABSTRACT

A unique, easily employable, portable, lap-oriented desk unit is achieved by providing securely affixing supporting cushion means to a housing assembly, which housing assembly comprises a work supporting surface and movable, fully contained illumination means associated therewith and movable between a first, stowed position, and a second deployed position, wherein said illumination means is in juxtaposed, spaced illuminating relationship with said work surface. In the preferred embodiment, the portable, lap-oriented desk unit also incorporates a secure, enclosed, storage zone in which any desired equipment for performing the particular work can be securely retained and stored for use when needed. In this way, a completely portable, easily employed lap-oriented desk unit is obtained which provides for secure storage of all of the requisite material needed for performing the work function, as well as providing portable, self-contained, self-powered illumination means for assuring complete illumination of the work surface whenever required.

18 Claims, 9 Drawing Figures

FIG. 5
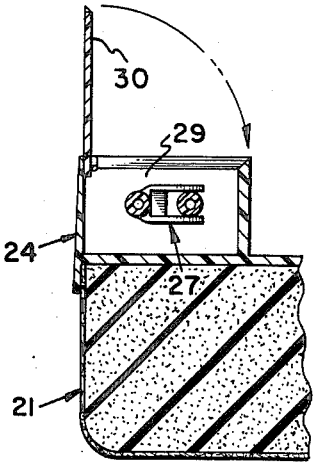
FIG. 6
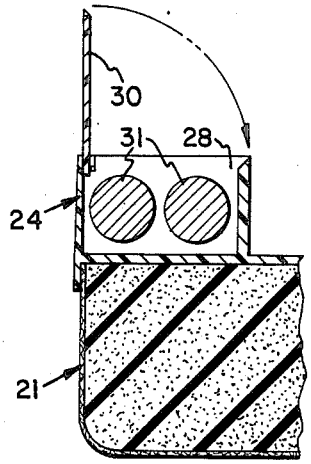
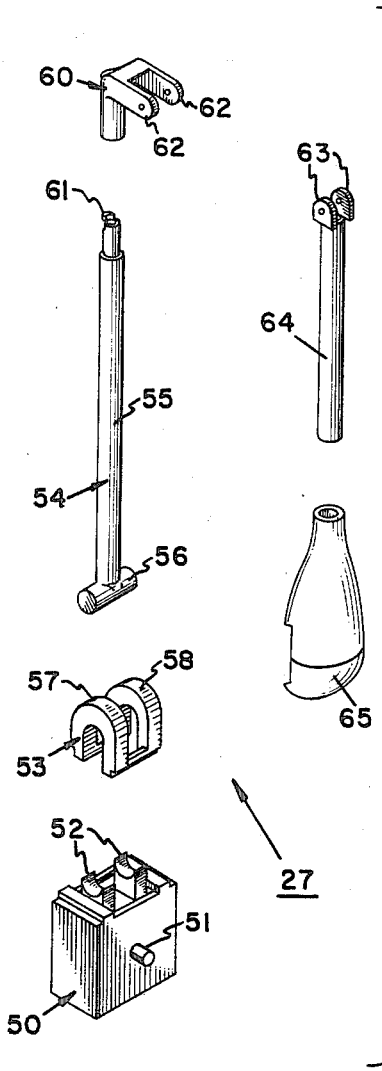
FIG. 7
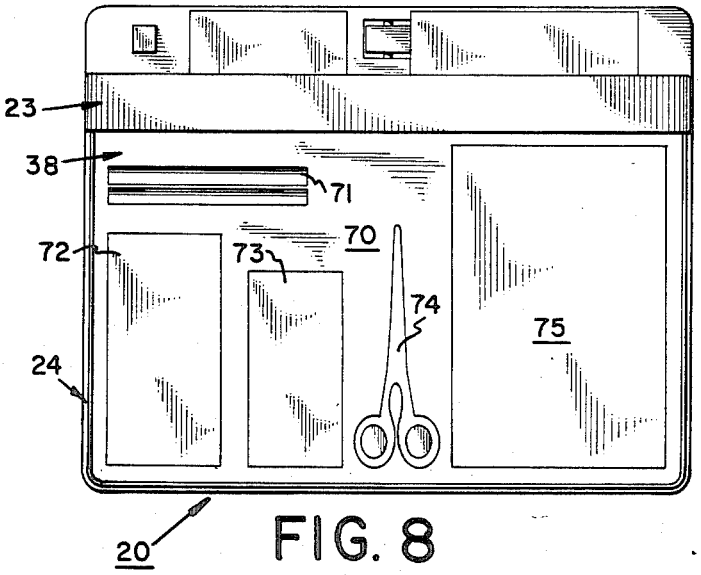
FIG. 8
FIG. 9
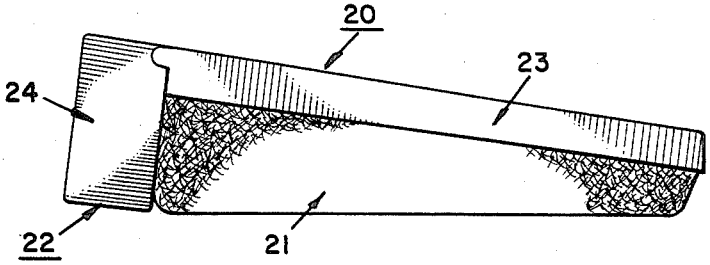

LAP-ORIENTED PORTABLE DESK UNITS

TECHNICAL FIELD

This invention relates to small, portable lap-type desk units, and more particularly to portable lap-type desk units incorporating illumination means, as well as storage zones.

BACKGROUND ART

In order to provide a portable working surface for people in our mobile society, several alternate construction for portable work surfaces have been developed. In general, these prior art structures comprise a substantially flat, hard surface upon which an individual can comfortably write, with the hard surface being securely affixed to a cushion, in order to allow the work surface to be comfortably placed on one's lap, or on other surfaces which are found inconvenient for writing or working. In this way, these areas, such as one's lap, are converted into a work surface on which writing, drawing, or other activities requiring a substantially hard, support surface can be achieved.

Although these portable lap-oriented work surfaces have been reasonably well received by the purchasing public, the user's of these prior art systems have found that the work surface is insufficient in fulfilling all the needs one would have while employing such a portable work surface.

In particular, the users of these prior art structures must hold all of the material they require while working, since no accommodations exist for holding extra materials. Furthermore, the user is limited in the use of these prior art structures since external light sources must be used to provide necessary illumination.

Therefore, it a principal object of the present invention to provide an easily employable, portable desk unit which incorporates a work support surface and also provides illumination means associated therewith, which is capable of fully illuminating the work surface, regardless of the location or illumination facilities existing in the area where use of the work surface is desired.

Another object of the present invention is to provide an easily employable, portable desk unit having the characteristic features described above which also incorporates a storage zone in which the user can easily store any required supplies or instruments which would be needed by the user.

Another object of the present invention is to provide an easily employable, portable desk unit having the characteristic features described above which also provides illumination means which are fully self contained in the desk unit in order to further enhance the complete portability of the desk unit and its usability in any desired location.

A further object of the present invention is to provide a portable, easily employable desk unit having the characteristic features described above which also provides pre-formed retaining zones for assuring the secure retention of the user's supplies or instruments in suitable and convenient secured areas.

Other and more specific objects will in part be obvious and will in part appear hereinafter.

SUMMARY OF THE INVENTION

The present invention eliminates all of the objections and difficulties which have been encountered with prior art units and provides a completely portable, easily employable desk unit which incorporates integral contained illumination means and built-in storage zones. In order to further enhance the portability and employability of the work surface, the desk unit of this invention incorporates cushion means affixed thereto, as has been done with prior art systems. In this way, one's lap or other inconvenient areas can be easily converted into a work area.

By employing the present invention, a fully self-contained lap-type desk unit is achieved which provides not only complete storage of all instruments and material required to perform the particular work desired, but also provides a completely self-contained, easily deployed light assembly which provides the user with complete illumination of the work surface whenever and wherever required. In this way, the prior art limitations are completely eliminated and the usability of the work surface is substantially enhanced and improved.

In the preferred embodiment of the present invention, the illumination means is constructed to be quickly and easily folded and stowed in a self-contained compartment found in the desk unit. In addition, a second easily accessible compartment is also formed in the desk unit for securely retaining battery means to provide for the efficient operation of the illumination means when desired. In the preferred embodiment, both of these compartments incorporate pivotable covers to assure the secure storage and non-visibility of the battery means and the illumination means, when access is not required.

Furthermore, whenever illumination is needed, the illumination means is constructed to be quickly and easily movable from its stowed position to its fully deployed position, ready for use. Preferably, the illumination means is constructed to be movably articulatable into a plurality of alternate positions, in order to further enhance the usability of the illumination means, and assure illumination is obtainable at any area of the working surface.

In the preferred embodiment of the present invention, the working surface is pivotally mounted to the support housing associated therewith, with the support housing incorporating a storage zone directly beneath the pivotable working surface. In this way, all of the materials and instruments required to perform the desired work function can be stored within the storage zone and easily accessed for use whenever desired.

In another embodiment of the present invention, the storage zone incorporates pre-formed retaining areas in which specifically sized and shaped instruments and materials can be conveniently and securely stored. In this way, the usability of the desk unit of the present invention is further enhanced.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 5 is a cross-sectional side elevational view of the desk unit of the present invention, partially broken away, taken along line 5—5 of FIG. 2;

FIG. 6 is a cross-sectional side elevational view of the desk unit of the invention, partially broken away, taken along line 6—6 of FIG. 2;

FIG. 7 is an exploded perspective view of the articulatable light assembly incorporated into the desk unit of the present invention;

FIG. 8 is a top plan view of an alternate embodiment of the desk unit of the present invention, shown with the working surface in its fully pivoted position to reveal the storage zone; and FIG. 9 is a side elevational view of a further embodiment of the desk unit of the present invention.

DETAILED DISCLOSURE

Figure 1:
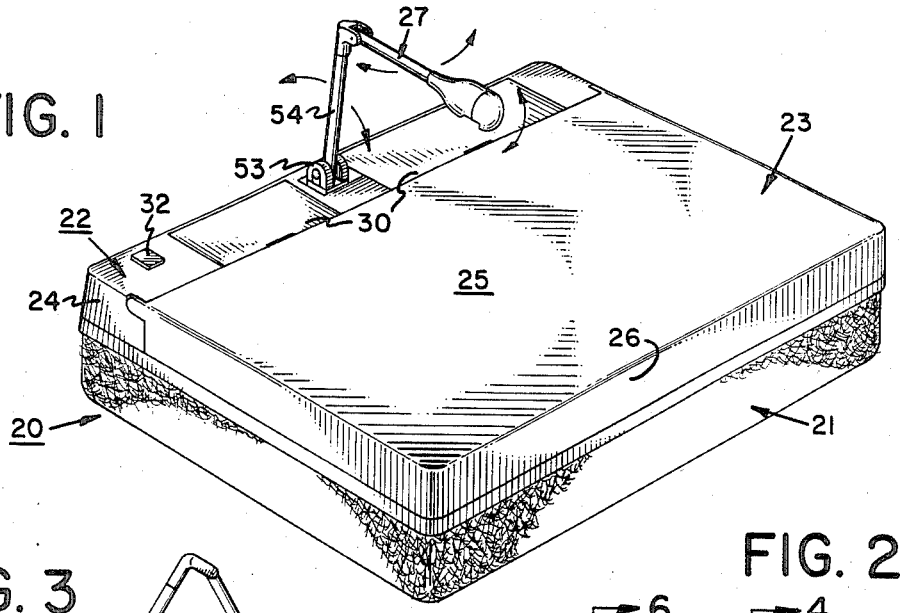
FIG. 1 is a perspective view of the portable desk unit of the present invention, shown with the illumination means in its fully deployed position, and with the working surface ready for use.

In FIG. 1, one embodiment of the desk unit 20 of the present invention is shown. In this embodiment, desk unit 20 comprises cushion means 21 and a housing assembly 22, which is securely mounted to and integrally connected with cushion means 21.

As detailed herein, housing assembly 22 provides in a single, compact construction, the working surface desired for performing the particular work functions, while also providing a storage zone in which desired instruments and material may be stored. Furthermore, housing assembly 22 incorporates illumination means which is quickly moved between a stowed position and a fully deployed position, providing the desired illumination to the working surface.

Figure 3:
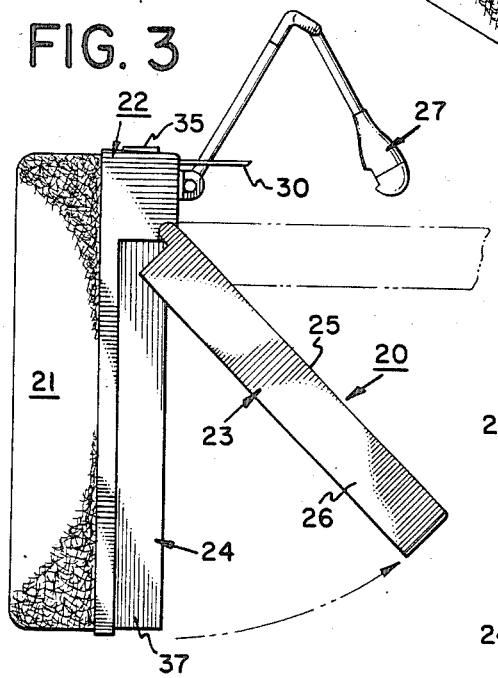
FIG. 3 is a side elevational view of the desk unit of the present invention shown with the work surface pivoted through a portion of its arcuate travel.
Figure 2:
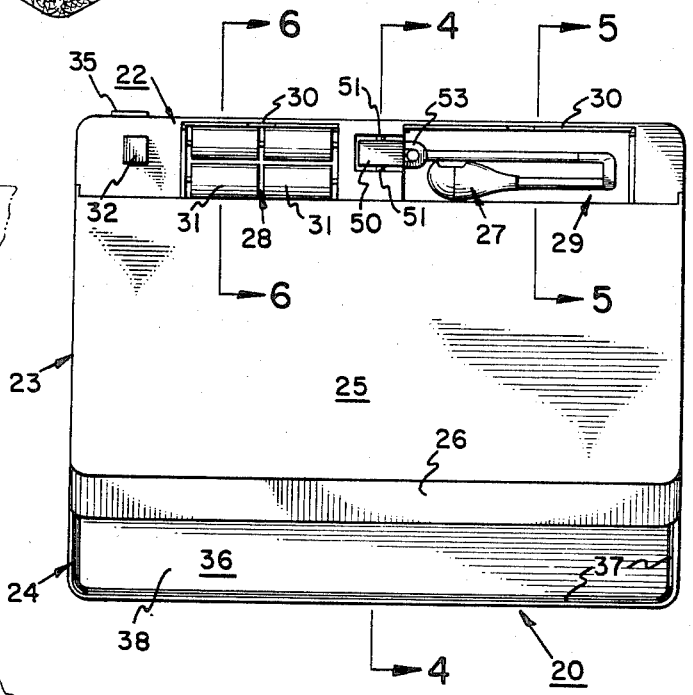
FIG. 2 is a top plan view of the desk unit of the present invention shown with the working surface pivoted upwardly through a portion of its arcuate travel.

As shown in FIGS. 1–3, housing assembly 22 incorporates a main housing portion 24 and a cover member 23, which is pivotally secured to main housing portion 24. Furthermore, cover member 23 incorporates a substantially flat, planar top surface 25 which forms the supporting working surface employed by the user whenever desired. In addition, cover member 23 incorporates a depending side edge 26, extending downwardly from flat surface 25, peripherally surrounding three of the four sides thereof.

In order to overcome one of the prior art difficulties and drawbacks, main housing portion 24 of housing assembly 22 incorporates illumination means 27. In the preferred embodiment, illumination means 27 is constructed to be movable between a first, stowed position, as shown in FIG. 2, and a second, fully deployed position, as shown in FIG. 1. Furthermore, as is more fully detailed below, illumination means 27 is constructed to be articulatably movable into a plurality of alternate positions, in order to assure the availability and usability of illumination means 27 in any desired position and location.

In order to provide the desired portability and operative ease for illumination means 27, main housing portion 24 of housing assembly 22 also incorporates compartments 28 and 29. As shown in FIGS. 2, 5, and 6, compartment 29 is constructed for receiving and securely retaining illumination means 27 in its stored position, when illumination is not required. Furthermore, in order to provide complete portability to desk unit 20 of the present invention, battery means 31 are securely retained in compartment 28, to provide the requisite power source for operating illumination means 27 whenever desired. In order to further enhance the aesthetically pleasing appearance and usability of desk unit 20, compartment covers 30 are pivotally affixed to main housing portion 24 of housing assembly 22 in cooperative, covering engagement with compartments 28 and 29.

If desired, as shown in FIGS. 2 and 3, desk unit 20 preferably incorporates an AC adapter plug-receiving means 35. This allows illumination means 27 to be powered directly from a conventional AC source, using an AC to DC converter which is well known in the art. The incorporation of AC adapter plug-receiving means 35 allows the user to save battery power, when an AC source is available.

In addition, in the embodiment shown in FIGS. 1–3, a readily accessible switch 32 is mounted to main housing portion 24 of housing assembly 22 to provide the user of desk unit 20 with an easily employable means for switching illumination means 27 on and off, whenever desired.

In an alternate construction, the separate, manually activated switch means 32 can be eliminated. Instead, the switch mechanism is constructed as an integral part of the illumination means assembly 27. In this alternate construction, the switch contacts would be constructed in a manner which would cause the illumination means to go "ON" whenever illumination means 27 is moved from its stowed position, as shown in FIG. 2, into its fully deployed position, as shown in FIG. 1. Similarly, whenever the illumination means is returned to the stowed position, the light would automatically be shut off.

Figure 4:
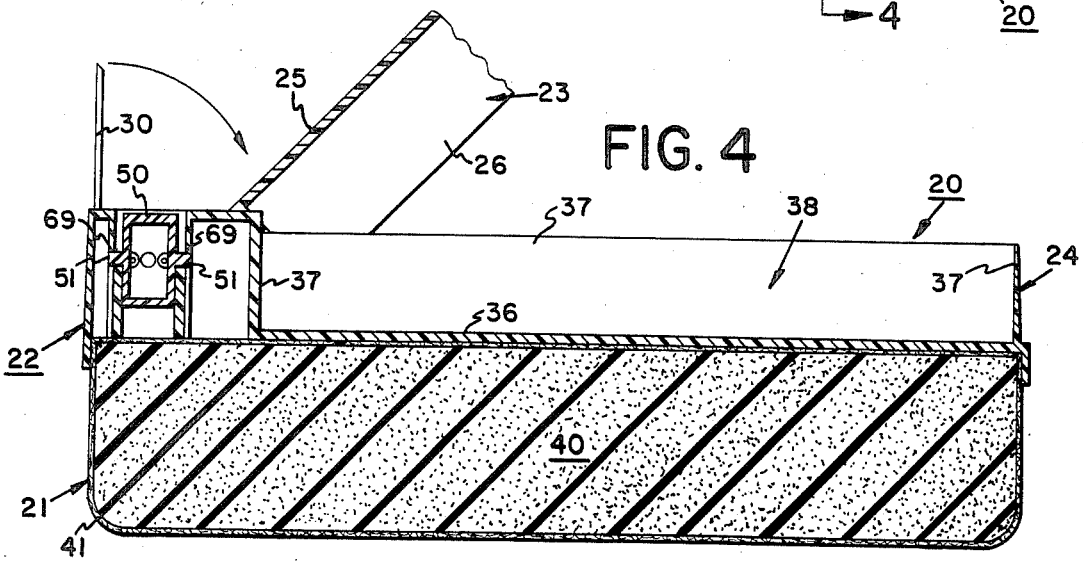
FIG. 4 is a cross-sectional side elevational view of the desk unit of the present invention taken along line 4—4 of FIG. 2

As best seen in FIGS. 2 and 4, main housing portion 24 of housing assembly 22 also incorporates a substantially flat supporting base 36, which forms a major part of main housing portion 24. Furthermore, upstanding walls 37 extend substantially perpendicularly from base 36, peripherally surrounding and enclosing base 36. In this way, a storage zone 38 is established.

By employing storage zone 38, the user of desk unit 20 can securely and conveniently retain instruments and material, such as paper, pencils, pens, books, stationery supplies, pictures, etc., directly in storage zone 38. In this way, desk unit 20 contains all of the equipment necessary for the user to perform the desired work. By providing storage zone 38, the complete portability and total independence of desk unit 20 of the present invention is further enhanced, and the usability of desk unit 20 in any desired situation with ease and convenience is readily apparent.

In order to assure that the material and equipment contained in storage zone 38 is securely retained, cover member 25 is pivotally mounted to main housing portion 24 in a manner which allows cover member 23 to be pivoted through an arc of about 90°. In this way, cover portion 23 can be moved completely away from storage zone 38, in order to assure complete access to the storage zone 38 for ease of placing and retrieving the desired material.

Furthermore, once all of the material desired is either stored or retrieved from storage zone 38, cover member 23 is pivoted back to its supported position, as shown in FIG. 1. In this position, substantially flat top surface 25 provides the user with the desired work area, while surface 25 and depending side edges 26 peripherally surround and securely close storage zone 38 to assure the material stored therein is safe and secure. As best seen in FIG. 3, depending side edge 26 of cover member 23 overlies upstanding wall 37 of storage zone 38. In this way, the secure retention of material stored in zone 38 is assured.

In addition, suitable, conventional latch means can be incorporated to provide a secure retained engagement between cover member 23 and the housing portion 24. In this way, accidental opening and possible loss of the material contained in storage zone 38 is prevented.

As shown in FIG. 4, the preferred embodiment of cushion means 21 comprises a central core of styrofoam 40, which is peripherally surrounded and retained by woven fabric layer 41. Although any desired stuffing or cushioning material can be employed, instead of styrofoam 40, and any other suitable outer cover can be used for woven material 41, it has been found that this combination is preferred for its wearability, as well as its comfort and usability.

As discussed above, one of the major features of desk unit 20 of the present invention is the incorporation of stowable, easily deployable illumination means 27, which provides the desired illumination to supporting work surface 25. Furthermore, as discussed above, and shown in FIG. 1, illumination means 27 is preferably capable of being moved into a plurality of alternate positions, in order to assure the complete illumination of any desired area of work surface 25.

In this regard, the components forming illumination means 27 are constructed to be arcuately movable, relative to each other, thereby providing and enhancing the desired inherent movability and flexibility of illumination means 27. This movability is shown in FIG. 1 by the directional arrows, which are associated with the movable components and represent the direction in which these components can be moved.

In order to best understand the relative movability of the components forming illumination means 27, reference should be made to FIG. 7, wherein an exploded perspective view of the components forming illumination means 27 is shown. As detailed therein, one of the components forming illumination means 27 comprises a pivot block 50.

As shown in FIG. 7, pivot block 50 incorporates a pivot post 51, which extends substantially perpendicularly from one side surface thereof. Although not shown in FIG. 7, pivot block 50 also incorporates a second pivot pin 51, extending perpendicularly from the opposite surface of block 50. In addition, block 50 incorporates two trunnions 52—52, extending perpendicularly from the top surface thereof. Preferably, trunnions 52—52 are each constructed with an arcuate, recess zone formed therein.

In addition to pivot block 50, illumination means 27 also incorporates a lower arm 54 and an arm mounting collar 53. Lower arm 54 comprises an elongated, substantially cylindrical shaft portion 55, which terminates in a support base having a substantially cylindrical shape, the central axis of which extends perpendicularly to the central axis of elongated shaft 55. Furthermore, support base 56 forms a substantially T-shaped member with shaft 55.

In order to impart arcuate movability to lower arm 54, cylindrical base 56 of lower arm 54 is constructed for mating supporting engagement with upstanding trunnions 52—52 of block 50. To provide secure retained pivoting interengagement of lower arm 54 relative to pivot block 50, mounting collar 53 is constructed with bifurcated, base engaging clamp portions 57 and 58.

With this construction, mounting collar 53 is inserted over the upper end of lower arm 54 and advanced along elongated shaft 55 until clamping portions 57 and 58 overlie, and securely retain cylindrical base 56 in supporting, pivoting interengagement with trunnions 52—52 of pivot block 50. In order to provide dependable, trouble-free pivoting engagement of lower arm 54 relative to block 50, mounting collar 53 is securely affixed to pivot block 50 by suitable fastening means, such as adhesive or member interlocking means.

As shown in FIG. 1, once mounting collar 53 is affixed to block 50, cylindrical base 56 of lower arm 54 is securely retained between bifurcated clamp portions 57 and 58 and trunnions 52—52 of block 50. Once in this securely retained position, lower arm 54 is capable of pivoting movement, both forwardly and rearwardly, through an arc of about 180°, about the axis defined by support base 56.

The next component which forms illumination means 27 is coupler 60. Coupler 60 is constructed for overlying, mating interengagement with the upper terminating end of lower arm 54. Once matingly engaged therewith, coupler 60 is capable of being arcuately pivoted about the axis defined by shaft 55.

As shown in FIG. 7, in the preferred embodiment, lower arm 54 incorporates a detent 61, which cooperatingly interengages with a mating groove formed in coupler 60. By employing this mating interconnection, the arcuate movability of coupler 60 relative to lower arm 54 is completely controlled, and the secure, locked interengagement of these two component parts is provided. Furthermore, if desired, by forming a detent receiving groove having a specific, limited arcuate length, the movement of coupler 60 relative to lower arm 54 can be controlled.

In the preferred embodiment, coupler 60 incorporates a fixed, substantially right angular shape, with twin supporting plate 62 extending from the central portion of coupler 60, substantially at right angles thereto. Support plates 62 are constructed for matingly engaging and securely retaining cooperating pivot plates 63 formed at one terminating end of upper arm 64. Plate 63 and 62 are pivotally mounted to each other through conventional means such as an elongated pivot pin interconnected therebetween. With this construction, upper arm 64 is easily pivoted relative to coupler 60 through an arc of almost 270°.

Finally, illumination means 27 is completed by securely affixing bulb housing and shade portion 65 to the opposed end of upper arm 64. In the preferred embodiment, housing/shade 65 is securely affixed to upper arm 64 for mounting retention thereon. However, if desired, housing/shade 65 can be pivotally mounted to arm 64 in order to provide arcuate pivoting movement of bulb housing and shade portion 65 relative to upper arm 64.

Although not shown, bulb housing/shade 65 incorporates a conventional light bulb and support member which is electrically connected to battery means 31 for providing the requisite power to the bulb means, when desired, for imparting the requisite illumination of the work surface.

With illumination means 27 constructed in the manner detailed above, base 50 is pivotally mounted to main housing portion 24 of housing assembly 22 in a manner which allows illumination means 27 to be quickly and easily moved between a stowed position, as shown in FIG. 2, and a fully deployed position, as shown in FIG. 1. The preferred pivotable, mounted engagement of block 50 with main housing portion 24 is best seen in FIG. 4.

As shown therein, main housing portion 24 incorporates pin receiving recesses 68 and 69 in which pivot pins 51—51 of block 50 are securely inserted, in locked, pivotable interconnection therewith. As shown in FIG. 2, once pivot block 50 is in its secure retained position with main housing portion 24, illumination means 27 can be quickly and easily moved between its first, stowed position, and its second, fully deployed, position.

When illumination means 27 is in its stowed position, as shown in FIG. 2, all the user needs to do is raise cover 30 of compartment 29 and, then, reach in and raise illumination means 27 out of compartment 29. While raising illumination means 27, block 50 pivots about the axis defined by pivot pins 51—51, which causes the entire illumination means to arcuately pivot out of compartment 29 and into its erect position, as shown in FIG. 1.

Once in the erect position, cover 30 is closed, in order to securely maintain illumination means 27 in its erect position, and upper arm 64 is swung outwardly to the position shown in FIG. 1, so that the illumination means is in juxtaposed, spaced cooperating relationship overlying illuminating work surface 25. Using the inherent arcuated relative movability of the components forming illumination means 27, as detailed above, illumination means 27 can be moved into the precisely desired position, to optimize the illumination desired by the user.

Once the use of desk unit 20 is completed, the illumination means is quickly and easily returned to its stowed position by merely pivoting upper arm 64 and housing/-shade 65 back to its juxtaposed, spaced, aligned relationship with lower arm 54. Then, cover 30 of compartment 29 is raised and illumination means 27 is pivoted arcuately about the axis defined by pivot pins 51—51 of block 50, causing the entire illumination means assembly 27 to pivot into compartment 29 until illumination means 27 is securely contained therein. Once in its final, stowed position, cover 30 is pivoted back into overlying relationship with compartment 29, thereby closing and protecting illumination means 27 in its stowed position.

In FIGS. 8 and 9, alternate embodiments of desk unit 20 of this invention are shown. In the embodiment shown in FIG. 8, desk unit 20 is shown with pivotable cover member 23 raised to a full, upright position. In this position, substantially the entire storage zone 38 is shown.

In this embodiment, main housing portion 24 incorporates a supporting base 70 in which a plurality of specifically shaped retaining zones 71, 72, 73, 74, and 75 are formed. In this embodiment supporting base 70 is constructed for securely holding and supportingly retaining typically required stationery supply items. For this construction, zone 71 contains writing instruments, while zones 72 and 73 retain various size envelopes or postcards. Zone 74 is constructed for retaining conventional scissors, while zone 75 is constructed for retaining conventionally sized stationery.

In this way, desk unit 20 is constructed for complete portability of entire stationery supply items to allow the user to comfortably write letters or other papers, in any desired location, with complete assurance that all of the supplies necessary for the work effort are securely stored within desk unit 20. In addition, desk unit 20 also comprises illumination means to assure complete illumination of the work surface whenever use of desk unit 20 is desired.

As will be readily apparent to one of ordinary skill in the art, desk unit 20 can be constructed with supporting base 36 or 70 of main housing portion 24 pre-formed to accommodate any desired shapes and sizes for securely retaining any particularly desired products, equipment, or supplies. Consequently, desk unit 20 of the present invention can be employed for securing children's crayons, paper and books, as well as required instruments for a complete manicure set or a complete, fully stored and securely retained hair grooming or makeup kit. Since all of these alternate constructions can be made without departing from the scope of the invention, these constructions are considered to be within the purview of the present invention.

In FIG. 9, an alternate configuration for desk unit 20 of the present invention is shown. In this configuration, desk unit 20 is constructed with pivoting cover member 23 being mounted to arcuately pivot relative to main housing portion 24 about one of its shorter edges, as opposed to the longer edge, shown in FIG. 1. Furthermore, cushion means 21 in this embodiment is shown to comprise a tapered profile, which provides a slanted, more convenient work surface to the user in some particularly desirable locations.

In addition, main housing portion 24 is constructed with a different profile. As shown in FIG. 9, main housing portion 24 forms the entire depth of desk unit 20 along one side thereof, with one side of cushion means 21 abutting main housing portion 24 and extending therefrom with its tapered profile. Although not shown in FIG. 9, this embodiment of desk unit 20 also incorporates a storage zone, as well as illumination means in order to provide a desk unit capable of being employed in an desired location and condition.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings, shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as now and desired to secure by Letters Patent is:

1. A portable desk unit constructed for providing an easily employable working surface for use wherever required, said unit comprising:

A. a cushion member
  a. comprising a size and shape for being supportingly positioned in the lap of the user.
  b. forming substantially the entire lower portion of said portable desk unit, and
  c. providing a comfortable support for positioning said desk unit in the user's lap or other desired location; and B. housing means securely affixed to said cushion member and incorporating a. a working surface supportingly retained therewith and providing an easily employable, readily accessible surface on which desired activity may be performed, b. movably adjustable, portable illumination means pivotally mounted to said working surface for movement between a first, folded, stowed position and a second, unfolded deployed position wherein said illumination means is in juxtaposed, spaced, overlying cooperating, movably articulatable relationship with said work surface for providing illumination to any desired location or area thereof and c. a first compartment formed in said housing means in cooperating relationship with the illumination means for stowably receiving the folded illumination means when said illumination means is in its first position;

whereby a completely portable, self-contained desk unit is realized, that is capable of providing its own, direct illumination of the work surface.

2. The portable desk unit defined in claim 1, further comprising:

C. a storage zone formed in said housing assembly for securely retaining the material positioned therein, increasing the usability of the desk unit by providing a zone in which the material to be used can be securely retained.

3. The portable desk unit defined in claim 2, wherein said storage zone is further defined as comprising a plurality of specifically dimensioned pre-formed holding zones, formed in the base thereof for receiving and securely holding specifically shaped articles therein.

4. The portable desk unit defined in claim 3, wherein said pre-formed zones are dimensioned for securely retaining stationary supplies.

5. The portable desk unit defined in claim 3, wherein said pre-formed zones are specifically designed for securely retaining manicuring and cosmetic supplies.

6. The portable desk unit defined in claim 1, wherein the housing means is further defined as comprising d. a main housing portion incorporating an enlarged open, central zone defined by peripherally surrounding walls and a substantially flat base, said open, central zone forming a storage area, and e. a storage area cover 1. positioned in juxtaposed spaced, cooperating, overlying relationship with said storage area,
2. pivotally secured along one edge thereof, with said main housing portion, and
3. the top surface thereof forming said working surface, whereby said cover means is movable from overlying, protective relationship with said storage zone, wherein said storage zone is completely closed, to an open position, wherein access to the storage zone is easily obtained.

7. The portable desk unit defined in claim 6, wherein said housing means is further defined as comprising:

f. a second compartment formed therein in juxtaposed, spaced cooperating relationship with said first compartment and positioned for retainingly securing battery means for powering the illumination means when desired.

8. The portable desk unit defined in claim 7, wherein the housing means further comprises switch means for connecting and disconnecting the light source of said illumination means with the battery means.

9. The portable desk unit defined in claim 8, wherein said switch means is formed with said illumination means to automatically connect the light source, with the battery means whenever the illumination means is moved from its first stowed position to its second deployed position, and to disconnect the light source from said battery means, whenever the illumination means is moved from its second, deployed position to its first, stowed position.

10. The portable desk unit defined in claim 8, wherein said switch means is further defined as comprising an ON/OFF switch mounted to the housing means and positioned for manual access by the user whenever desired.

11. The portable desk unit defined in claim 6, wherein said cover is further defined as being removably pivotally mounted to said main housing portion by pivot pins formed on opposed sides of said cover.

12. The portable desk unit defined in claim 1, wherein said cushion means is further defined as comprising a tapered profile to impart a gentle, general sloping slant to the working surface, to provide improved positioning for said working surface in particular applications.

13. The portable desk unit defined in claim 1, wherein said illumination means is further defined as comprising 1. at least two pivotally interconnected arm portion
2. one of said arm portions being pivotally secured to a mounting block, and
3. said mounting block being pivotally secured to the housing means in juxtaposed, spaced, cooperating relationship with the first compartment, thereby providing an illumination means assembly which allows the illumination means to be quickly and easily pivoted from its stowed position to its fully deployed position, as well as manually adjusting to any desired illumination position in juxtaposed, spaced, overlying relationship with said working surface providing illumination directly thereto.

14. A portable desk unit constructed for providing an easily employable working surface for use wherever required, said unit comprising A. a cushion member a. comprising a size and shape for being supportingly positioned in the lap of the user, b. forming substantially the entire lower portion of said portable desk unit, and c. providing a comfortable support for positioning said desk unit in the user's lap or any other desired location; and B. housing means securely affixed to said cushion member and incorporating p2 a. a working surface supportingly retained therewith and providing an easily employable, readily accessible surface on which desired activity may be performed, b. a first compartment formed in said housing means in cooperating relationship with illumination means for stowably receiving the illumination means when said illumination means is in its first position, and c. illumination means pivotally mounted to said housing means for movement between a first, stowed position and a second, deployed position wherein said illumination means is movably adjustable and articulatable in juxtaposed, spaced, overlying, cooperating, relationship with said working surface for providing illumination thereto in any desired location thereof, said illumination means comprising 1. a mounting block pivotally secured to the housing in juxtaposed, spaced cooperating relationship with the first, storage compartment, thereby allowing said illumination means to be quickly and easily pivoted into and out of said first compartment when desired,
2. a first arm member pivotally mounted to said mounting block at the proximal end thereof, providing said arm member with arcuate movability through a distance of at least 100° relative to said mounting block,
3. a second arm member pivotally mounted at its proximal end in juxtaposed, spaced, cooperating engagement with the distal end of the first arm member, and pivotally movable through an arc of at least 100° relative to the distal end of said first arm member, and
4. a lamp and hood assembly pivotally mounted to the distal end of said second arm member for axial movement relative thereto, whereby said illumination means when in its second, deployed position, is quickly and easily moved into a plurality of various articulatable positions in juxtaposed, spaced, overlying, cooperating relationship with said work surface, providing illumination to any desired location thereof;

whereby a completely portable self-contained desk unit is achieved, capable of providing its own, self contained direct illumination to any desired location of the work surface while positioned above the work surface.

15. The portable desk unit desk unit defined in claim 14, wherein said illumination means is further defined as comprising:

5. an arm bracket
   i. pivotally secured at one end thereof to the distal end of said first arm member and movable relative thereto through an arc of at least 180°, and
   ii. incorporating mounting means for securely retaining the second arm member in secure, pivotable mounted engagement therewith, thereby assuring the arcuate movability of said second arm member relative to said first arm member.

16. The portable desk unit defined in claim 14, wherein said first arm member is further defined as comprising a substantially cylindrically shaped supporting base formed at the proximal end thereof and said mounting block is further defined as comprising:

i. upstanding trunnion members positioned for supportingly receiving the cylindrical support base of said first arm member, and
ii. collar means peripherally surrounding and securely retaining said substantially cylindrical support base of said first arm member to said upstanding trunnion members, thereby assuring the free pivotable movability of said first arm member relative to said mounting base.

17. The portable desk unit defined in claim 14, wherein said housing means is further defined as comprising d. a main housing portion incorporating an enlarged open central zone defined by peripherally surrounding walls and a substantially flat base, said open, central zone forming a storage area, and
e. a storage area cover
   1. positioned in juxtaposed, spaced, cooperating, overlying relationship with said storage area,
   2. pivotally secured to said main housing portion by pivot pins formed at opposed sides of said cover, said pivot pins engaging in pin receiving means formed in said main housing portion, and
   3. the top surface thereof forming said working surface whereby said cover means is movable from overlying protective relationship with said storage zone, wherein said storage zone is completely closed to an open position, wherein access to the storage zone is easily obtained.

18. The portable desk unit defined in claim 17, wherein said housing means is further defined as comprising:

f. a first compartment cover pivotally mounted to said housing means in overlying, pivotable engagement with said first compartment, thereby allowing said illumination means to be positioned in its first retained position, with said cover means closing said compartment and storing said illumination means therein free from view.

* * * * *